United States Patent [19]

Bando

[11] Patent Number: 4,660,327

[45] Date of Patent: Apr. 28, 1987

[54] GLASS PLATE GRINDING APPARATUS

[75] Inventor: Shigeru Bando, Tokushima, Japan

[73] Assignee: Bando Kiko Co., Ltd., Tokushima, Japan

[21] Appl. No.: 769,165

[22] Filed: Aug. 23, 1985

[30] Foreign Application Priority Data

Oct. 13, 1984 [JP] Japan ..... 59-154962[U]

[51] Int. Cl.[4] ..... B24B 9/10

[52] U.S. Cl. ..... 51/110; 51/215 E; 51/283 E; 198/627

[58] Field of Search ..... 51/76 R, 110, 138, 215 E, 51/215 M, 283 E; 198/626, 627, 628

[56] References Cited

U.S. PATENT DOCUMENTS

| | | | |
|---|---|---|---|
| 2,600,127 | 6/1952 | Reaser | 51/3 |
| 3,454,142 | 7/1969 | Holstein | 198/626 |
| 3,738,260 | 6/1973 | Navi et al. | 198/626 X |
| 3,841,027 | 10/1974 | Bando | 51/110 |
| 4,079,551 | 3/1978 | Bando | 51/110 |
| 4,493,167 | 1/1985 | Bovone | 51/110 |

FOREIGN PATENT DOCUMENTS

| | | | |
|---|---|---|---|
| 274535 | 9/1965 | Australia | 198/626 |

*Primary Examiner*—Robert P. Olszewski
*Attorney, Agent, or Firm*—Michael N. Meller

[57] ABSTRACT

A glass plate grinding apparatus has a press conveyor disposed on one side of a glass plate where a grinding wheel is disposed and a support conveyor disposed on the other side of the glass plate, the press conveyor being constituted by a caterpillar conveyor having holding members attached to an endless chain and the lower ends of the holding members being situated above the lower end of the support conveyor to form a step, wherein each of the holding members of the press conveyor has a thin plate-like member extended downwardly that presses the glass plate to the support conveyor. The press conveyor is supported vertically adjustably to the machine main body by way of a vertically elevating device, such that the thin plate-like member is situated between the grinding wheel and the glass plate when the press conveyor is lowered.

3 Claims, 4 Drawing Figures

GLASS PLATE GRINDING APPARATUS

FIELD OF THE INVENTION

This invention concerns a glass plate grinding apparatus such as a beveling machine for chamfering straight edges of glass plates or an edging machine for grinding straight cut ends of glass plates.

More specifically, it relates to a glass plate grinding apparatus having a structure for vertically placing a glass plate while directing an edge to be ground downwardly (while slanting slightly relative to the vertical plane) and grinding the lower edge of the glass plate by a plurality of grinding wheels disposed in a row while seizing both sides of the glass plate by a pair of conveyors and conveying the glass plate linearly.

BACKGROUND OF THE INVENTION

Heretofore, paired conveyors for seizing and conveying a glass plate have comprised a combination of a support conveyor for supporting the glass plate in a defined state and a press conveyor for pressing and holding the glass plate against the support conveyor.

The press conveyor has a width narrower than that of the support conveyor and the lower end of the press conveyor is situated above the lower edge of the glass plate to be conveyed, the press conveyor being so constructed that the glass plate is resiliently pressed toward the support conveyor.

A plurality of grinding wheels are disposed in series below the press conveyor.

On the other hand, the support conveyor is extended near the lower edge of the glass plate so as to support the glass plate put under a grinding load over a range as wide as possible.

That is, the support conveyor is situated on the side of the glass plate opposite to the side where the grinding wheel is disposed. The lower end of the support conveyor is situated below the lower end of the press conveyor and above the lower edge of the glass plate.

The glass plate is seized between the press conveyor and the support conveyor. At a stepped portion formed between the lower end of the press conveyor and the lower end of the support conveyor, the glass plate is disposed such that it is supported on one side thereof by the support conveyor and exposed on the other side thereof to the press conveyor with the lower edge being exposed downwardly. The exposed side and the lower edge of the glass plate are chamfered or ground by the grinding wheels.

The structure of the conveyor may generally be classified into two types, that is, a caterpillar conveyor type in which rectangular holding members are attached to an endless chain and a conventional belt conveyor type.

The conveyor system according to this invention includes such a system where the caterpillar conveyor is employed for both the press conveyor and the support conveyor and such a combination system in which the caterpillar conveyor is used for the press conveyor and the belt conveyor is used for the support conveyor.

However, the size of a glass plate capable of being subject to chamfering or edge grinding is restricted by the distance of the step portion between the press conveyor and the support conveyor in the conventional glass plate grinding apparatus having the foregoing structure. That is, a glass plate of a size smaller than the distance of the step cannot be held between the conveyors. Further, even if a glass plate has a size a little larger than the distance of the step, it cannot be held firmly between the conveyors but rather is readily displaced during grinding work, by which the grinding of the glass plate in such size cannot be effected.

Thus, a grinding apparatus adapted to perform grinding or beveling for a glass plate of a larger width cannot be applied to grinding or beveling for a smaller size glass plate.

On the other hand, in a grinding apparatus in which the step is reduced for the purpose of beveling and grinding a smaller size glass plate, if a grinding wheel is brought into contact with the glass plate over a wide range (with a smaller angle of contact), for performing beveling over a large width, the wheel will fail to perform the beveling due to contact with the press conveyor.

As a countermeasure, a grinding apparatus in which the support conveyor is made movable vertically relative to the press conveyor has been known.

In the case of performing beveling over a larger width, the support conveyor is lowered to descend the lower pass line of the glass plate so that the area of contact of the grinding wheel with the glass plate is made wider.

In the case of beveling or grinding a smaller size glass plate, the support conveyor is moved upwardly to raise the pass line of the glass plate, and at the same time the step between the press conveyor and the support conveyor is decreased and the glass plate small in size is seized, so that the area of contact of the grinding wheel with the glass plate is decreased for performing beveling over a narrow width.

However, in the grinding apparatus of this type, since the height of the lower pass line of the glass plate varies depending on the vertical movement of the support conveyor, vertical adjustment has been required each time for the glass plate feed conveyor and discharge conveyor connected to the apparatus main body.

Further, variation of the pass line of the glass plate relative to the grinding wheels requires the adjustment of the position of the water feed pipe or the like to the grinding wheels, re-adjustment of the status and position of the grinding wheels which have previously been adjusted and set, and replacement of the grinding wheels due to the change in the grinding position.

SUMMARY OF THE INVENTION

In view of the foregoing, it is an object of this invention to provide a grinding apparatus capable of eliminating the foregoing drawbacks in the prior art glass plate grinding apparatus.

More specifically, it is an object of this invention to provide a grinding apparatus capable of beveling and grinding a small size glass plate and optionally beveling over a larger width.

Another object of this invention is to provide a glass plate grinding apparatus in which the pass line of the glass plate does not change at all and, accordingly, the grinding wheels can perform grinding work under the same status or like conditions irrespective of the size of the glass plate and beveling width.

A further object of this invention is to provide a glass plate grinding apparatus capable of quite firmly holding a glass plate of a smaller size during beveling or grinding, optionally changing the holding position for the glass plate and also optionally changing the beveling width.

BRIEF DESCRIPTION OF THE DRAWINGS

For the better understanding of the object of this invention, this invention will now be described by way of its preferred embodiment referring to the accompanying drawings, with no particular restriction of the invention thereto, wherein.

DETAILED DESCRIPTION OF THE PREFERRED EMBODIMENT

Figure 1:
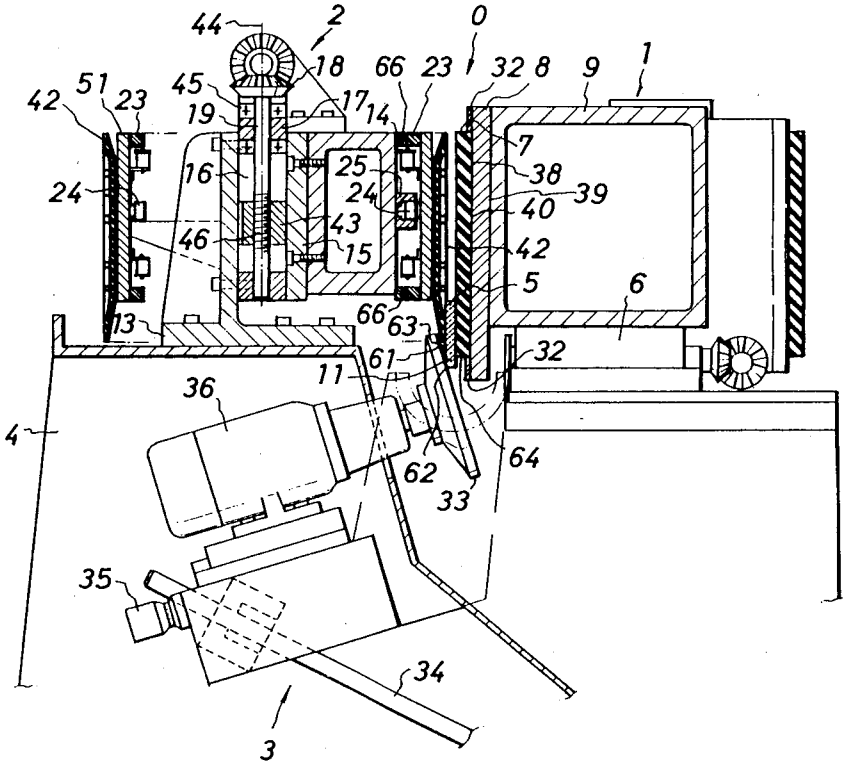
FIG. 1 is a cross-sectional view of a preferred embodiment according to this invention.
Figure 2:
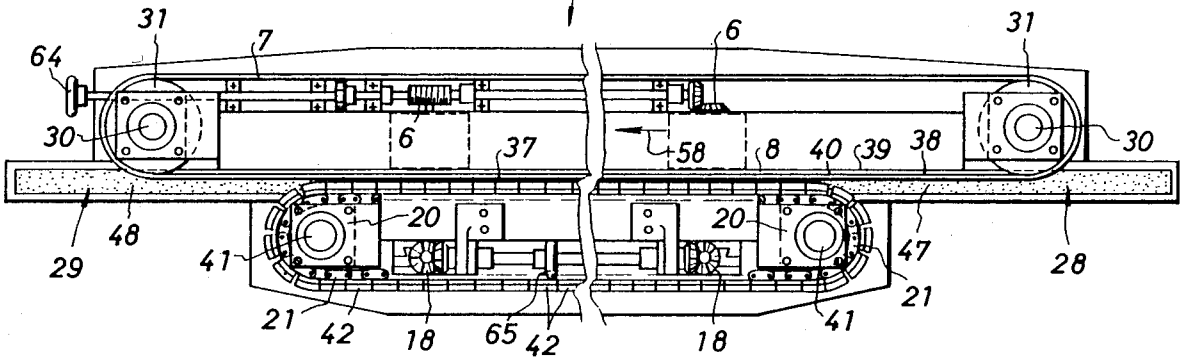
FIG. 2 is a plan view of the embodiment shown in FIG. 1.

As shown in FIGS. 1 and 2, a glass plate grinding apparatus 0 mainly comprises an apparatus main body or a base 4, a support conveyor device 1, a press conveyor device 2 and a plurality of grinding wheel devices 3 (only one of them is illustrated in the drawings) arranged in a row below the press conveyor device along the edge of the glass plate.

The base 4 has a structure such that the support conveyor device 1, the press conveyor device 2 and the grinding wheel device 3 are disposed respectively for grinding a glass plate 5.

The grinding wheel device 3 comprises a grinding wheel 33 for rotationally grinding the glass plate 5, a motor 36 for rotationally driving the grinding wheel 33, a member 35 for adjusting the approach and withdrawal of the grinding wheel 33 toward and from the glass plate 5 respectively, thereby adjusting the grinding depth of the glass plate 5 which is ground by the grinding wheel 33, and a member 34 for adjusting the abutting angle of the grinding wheel 33 relative to the glass plate 5.

The support conveyor device 1 comprises two bearing devices 30 (see FIG. 2) mounted near the respective longitudinal ends of the base 4, drums 31 each having a shaft rotatably supported at the bearing portion in each of the bearing devices 30, an endless belt 7 laid around these drums 31 for circulatorily moving along the rotating direction of the drums 31, a belt support plate 8 for supporting the endless belt 7 from the inner side of the endless belt 7, guide members 32 disposed above and below the belt support plate 8 for preventing the irregular movement of the endless belt 7, a support conveyor frame 9 that secures the belt support plate 8 and a horizontal sliding device 6, which is disposed below the support conveyor frame 9 and mounted to the base 4 for carrying out adjustment of the horizontal position of the support conveyor frame 9 by movement toward and away from the press conveyor device 2.

The press conveyor device 2 comprises sprockets 20 mounted near the respective longitudinal ends of the base 4 and each having a rotatably supported shaft 41, a driving device (not shown) for rotationally driving at least one of the sprocket shafts 41, an endless chain 21 laid around the rotationally driven sprockets 20 for performing circulating movement, a plurality of holding members 42 mounted over the entire outer circumference of the endless chain 21 for holding the glass plate 5, rollers 24 mounted near the back of the holding members 42 respectively for regulating the vertical movement of the holding members 42, sliding members 23 attached to the upper and lower portions of the holding members 42, a press conveyor frame 14 for slidably supporting the sliding members 23, guide grooves 25 disposed on the press conveyor frame 14 for defining the upper and lower positions of the roller 24, a vertically sliding member 15 mounted at the back of the press conveyor frame 14 and having a nut member 43, a slide block 16 engaging the vertically sliding member 15 slidably and having a shaft bearing 45 disposed coaxially with the axial center 44 for the nut member 43, a shaft 19 which is situated coaxially with the axial center 44 for the bearing 45 and the nut member 43 and has a feed screw 46 engageable with the nut member 43 for vertically displacing the nut member 43 through the engagement between the feed screw 46 and the nut member 43 upon rotation of the feed screw 46, thereby vertically moving the sliding member 15, a bevel gear device 18 for rotating the shaft 19 by means of a vertical slide adjusting knob 65, and a bracket 13 for securing the slide block 16 to the base 4.

A feed conveyor device 28 is adapted to move a vertically placed glass plate 5 to be ground while carrying it on an endless feed belt 47.

A discharge conveyor device 29 is adapted to take out the glass plate 5 which has been ground while carrying it on an endless belt 48.

Figure 3A:
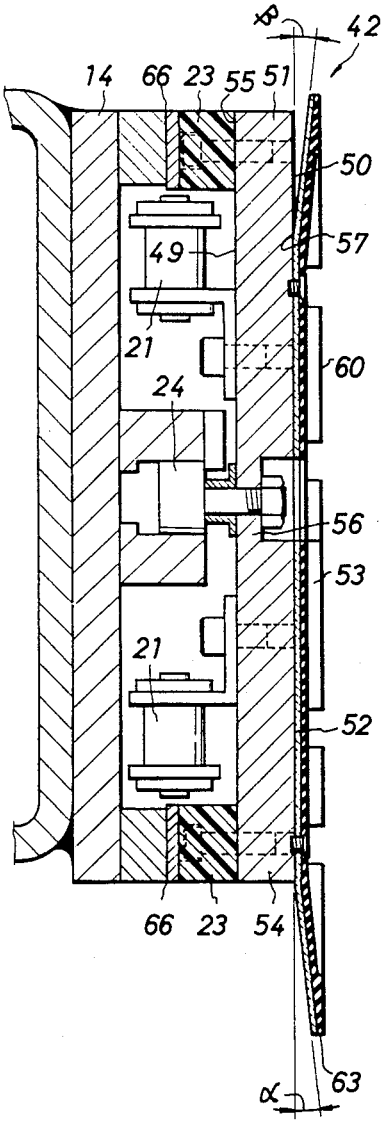
FIG. 3*a* is an enlarged side view of a holding member in a press conveyor device shown in FIG. 1.
Figure 3B:
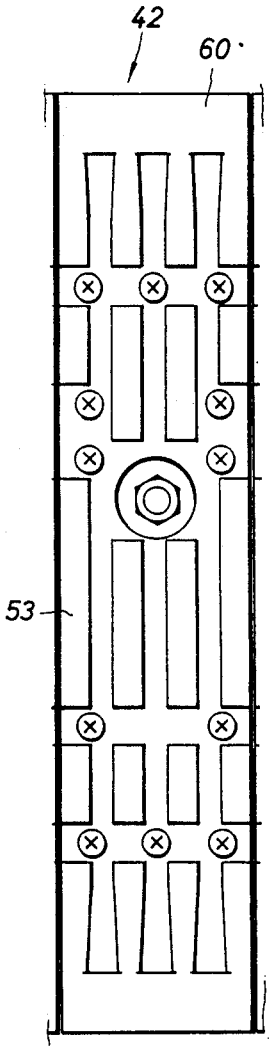
FIG. 3*b* is an enlarged front view of the holding member shown in FIG. 1.

As shown in FIGS. 3*a* and 3*b*, the holding member 42 has a rectangular-shaped base member 51. To the back side 49 of the base member 51, there are secured the sliding members 23 which slide on the surface of the sliding face 66 connected to the conveyor frame 14 near the upper end 55 and the lower end 54 of base member 51, the roller 24 near the central portion 56 of base member 51 and the endless chains 21 between the sliding members 23 and the roller 24, respectively. A thin press plate 52 is attached on the surface 50 of the base member 51 such that the plate 52 protrudes from the lower end 54 of the base member 51 and is bent at the position of the lower end 54 by an angle $\alpha$ toward the glass plate 5 to be held and bent at a position 57 below the upper end 55 by an angle $\beta$ toward the glass plate 5 to be held. The press plate 52 is desirably made of metal such as steel and is required to firmly press the glass plate 5 resiliently at the bent portions. The surface of the thin press plate 52 on the side which holds the glass plate 5 is appended with a resilient member 53 for resiliently holding the glass plate 5 without slippage while not damaging the plate. As shown in FIG. 3*b*, the front face of the resilient member 53 is formed with unevenness such that the glass plate 5 may firmly and securely be held. The resilient member 53 is desirably formed with material such as rubber having a soft surface capable of firmly holding the glass plate 5 without damaging it. The angles $\alpha$ and $\beta$ are desirably identical with each other.

The glass plate grinding apparatus thus constituted operates as described below. At first, as shown in FIG. 2, the endless feed belt 47 of the feed conveyor device 28 is driven by an appropriate driving means (not illustrated) along and toward the gap 37 defined between the support conveyor device 1 and the press conveyor device 2. Further, the endless chain 21 of the press conveyor device 2 is also driven by way of the sprockets 20 by an appropriate driving means (not illustrated) and the base members 51 attached to the endless chain 21 and the thin press plates 52 attached to the base members 51 move in the direction of the arrow 58. Under this state, the glass plate 5 is placed vertically on the endless belt 47 of the feed conveyor device 28 and put into the gap 37 formed between the press plate 52 of the press conveyor device 2 and the endless belt 7 of the support conveyor device 1. During movement through the gap 37, the glass plate 5 is conveyed while being seized between the endless belt 7 of the support conveyor device 1 and the press plate 52 of the press conveyor device 2. The extent of the gap 37 is previously adjusted by the horizontal sliding device 6 of the support conveyor device 1 so as to attain a required seizing force depending on the thickness of the glass plate 5 to be ground. The grinding wheel device 3 is adjusted by the angle adjusting member 34 with respect to the beveling angle and by the depth control member 35 with respect to the chamfering depth for the glass plate 5 to be ground respectively. The press plate 52 of the press conveyor device 2 is adjusted by the vertically sliding screw device 17 while considering the size and beveling angle for the glass plate 5 to be ground, so that it is set to such a position where the plate 52 can firmly hold the glass plate 5 and the grinding wheel 33 does not abut against the base member 51 and the like. The glass plate 5 is seized between the press plate 52 and the endless belt 7 and subjected to grinding such as chamfering by the grinding wheel 33 while being seized and conveyed in the direction of the arrow 58.

The glass plate 5 which has passed through the gap 37 while being sustained by the seizing force is now placed on the endless belt 48 of the discharge conveyor device 29, conveyed thereon in the vertically oriented state and then taken out.

As described above, in this embodiment, the step 11 between the lower end 64 of the support conveyor device 1 and the lower end 63 of the press conveyor device 2 (that is, the lower end of the thin press plate 52) can optionally be varied.

Accordingly, in a case where the size of a glass plate is large and beveling is intended for a broader width, the press conveyor device 2 is elevated to make the step 11 larger. Then, the grinding wheel 33 can be abutted against the glass plate 5 with a reduced angle of contact without contacting the holding member 42 of the press conveyor device 2 and the like, thereby beveling for the broader width can be carried out as desired. Further, since the thin press plate 52 is extended downwardly from the lower end of the base member 51 in each of the holding members 42 of the press conveyor device 2, the thin plate member 52 can be situated between the grinding wheel 33 and the glass plate 5 by lowering the press conveyor device 2.

Since the thin plate member 52 attached to the holding member 42 has a reduced thickness, it can be situated between the glass plate 5 and the grinding wheel 33 to hold the glass plate 5 with no contact of plate member 52 with the grinding surface 61 of the grinding wheel 33. Further, even if the grinding wheel 33 is abutted against the glass plate 5 with a small angle of contact in this state, the grinding surface 61 of the grinding wheel 33 does not contact the thin plate member 52.

Accordingly, since the glass plate 5 of a smaller size can be held nearer to the grinding point, a firm holding is enabled to thereby perform stable and accurate beveling and edging for the cut edge.

Further, since the position where the thin plate member 52 holds the glass plate 5 can optionally be varied by adjusting the vertical position of the press conveyor device 2 at the state of beveling the glass plate 5 of smaller size, beveling and grinding for various width can be conducted depending on various small sizes of glass plates.

Furthermore, the press conveyor device 2 is adjusted vertically, and the thin plate member 52 is attached to the base member 51 and situated between the grinding wheel 33 and the glass plate 5 so as to perform the beveling and the cut edge grinding to a smaller size glass plate, in accordance with the invention. Accordingly, the lower pass line of the glass plate 5 does not change at all. Therefore, troublesome procedures such as re-adjustment and replacement for the grinding wheels as well as vertical adjustment for the feed conveyor and discharge conveyor, etc. as described above for the foregoing conventional grinding apparatus are not required.

What is claimed is:

1. A glass plate grinding apparatus comprising:

a belt conveyor means for conveying said glass plate, having a belt, which is endless in a circulatorily moving direction, for supporting one surface of the glass plate to be grinded;

a plurality of strip-like base members disposed parallel to each other, one surface of each base member being arranged to face toward the other surface of the glass plate;

a support frame for slidably supporting said base members;

a plurality of thin plate-like members, each having a thickness less than that of a corresponding one of the base members, and being attached to said one surface of the corresponding base member to seize said glass plate in cooperation with said belt and to expose one end portion of said other surface of said glass plate, the end of each plate-like member which is situated at said one end portion of said glass plate protruding from one end of the corresponding base member;

an endless chain disposed on the other surface of said base members for moving said base members in the moving direction of said glass plate;

a grinding wheel having a grinding face and arranged to grind said exposed one end portion of said glass plate; and a position adjusting device connected to said support frame for adjusting a position of said one end of said thin plate-like members in a direction substantially perpendicular to the moving direction of said glass plate wherein said one end extends into the space between said grinding face of the wheel and said other surface of said glass plate.

2. The glass plate grinding apparatus as defined in claim 1, wherein each thin plate-like member is bent by a predetermined angle at a predetermined position toward the glass plate in order to resiliently hold the glass plate and a resilient member is provided on the surface of said thin plate-like member to resiliently hold the glass plate without slippage and without damage to the glass plate.

3. The glass plate grinding apparatus as defined in claim 2, wherein the surface of the resilient member has an uneven profile for enabling the resilient member to firmly and reliably hold the glass plate.

* * * * *